US012310429B2

(12) United States Patent
Hanna

(10) Patent No.: US 12,310,429 B2
(45) Date of Patent: May 27, 2025

(54) STRAPLESS ADHESIVE BREAST COVERS

(71) Applicant: Talene Hanna, Greystanes (AU)

(72) Inventor: Talene Hanna, Greystanes (AU)

( * ) Notice: Subject to any disclaimer, the term of this patent is extended or adjusted under 35 U.S.C. 154(b) by 0 days.

(21) Appl. No.: 18/560,650

(22) PCT Filed: Jun. 17, 2022

(86) PCT No.: PCT/AU2022/050606
§ 371 (c)(1),
(2) Date: Nov. 13, 2023

(87) PCT Pub. No.: WO2022/261718
PCT Pub. Date: Dec. 22, 2022

(65) Prior Publication Data

US 2024/0277080 A1 Aug. 22, 2024

(30) Foreign Application Priority Data

Jun. 18, 2021 (AU) ..... 2021901836

(51) Int. Cl.
*A41C 3/06* (2006.01)

(52) U.S. Cl.
CPC ..... *A41C 3/065* (2013.01)

(58) Field of Classification Search
CPC ..... A41C 3/065
USPC ..... 450/81
See application file for complete search history.

(56) References Cited

U.S. PATENT DOCUMENTS 3,280,818 A * 10/1966 Pankey ..... A41C 3/065 450/81
5,755,611 A * 5/1998 Noble ..... A41C 3/065 450/39
6,200,195 B1 * 3/2001 Furuno ..... A41C 3/065 450/81
6,371,831 B1 4/2002 Dodge
(Continued)

FOREIGN PATENT DOCUMENTS

EP 1736066 A1 12/2006
JP 3152752 U 8/2009
WO 2013004168 A1 1/2013

OTHER PUBLICATIONS

International Preliminary Report on Patentability dated Apr. 17, 2023 from PCT Application No. PCT/AU2022/050606.
(Continued)

*Primary Examiner* — Gloria M Hale
(74) *Attorney, Agent, or Firm* — INNOVATION CAPITAL LAW GROUP, LLP; Vic Lin

(57) ABSTRACT

There are provided a pair of breast covers, each breast cover forming a cup shape defining a concave inner surface and a convex outer surface, defining an ovular cross section having a major axis and a minor axis, being symmetric with respect to the major axis and asymmetric with respect to the minor axis. Each cover further comprises a peripheral adhesive layer on the inner surface thereby defining an adhesive-free central portion at an intersection of the axes. Wearing the covers comprises adhering the covers to respective breasts in first orientations generally symmetric with a centre line therebetween for a first type of garment and in second orientations generally symmetric with the centre line therebetween for a second type of garment.

20 Claims, 3 Drawing Sheets

(56) References Cited

U.S. PATENT DOCUMENTS

| | | | | |
|---|---|---|---|---|
| 6,758,720 | B2 * | 7/2004 | Chen | A41C 3/065 450/57 |
| 6,780,082 | B2 * | 8/2004 | Moore | H01L 22/26 451/6 |
| 6,852,001 | B2 * | 2/2005 | Chen | A41C 3/065 450/57 |
| 7,152,606 | B1 | 12/2006 | Schindler | |
| 7,278,899 | B2 * | 10/2007 | Davis | A41C 3/065 450/38 |
| 7,407,429 | B2 * | 8/2008 | Chen | A41C 3/065 450/81 |
| 7,677,952 | B2 * | 3/2010 | Wooley | A41C 3/065 450/86 |
| 8,029,332 | B2 | 10/2011 | Deal et al. | |
| 8,371,902 | B2 * | 2/2013 | Sherwood | A41C 3/065 450/38 |
| 8,647,169 | B2 * | 2/2014 | Chang | A41C 3/065 450/38 |
| 9,011,201 | B2 * | 4/2015 | Chen | A41C 3/065 450/86 |
| D854,786 | S * | 7/2019 | Esau | D2/737 |
| 10,524,519 | B2 * | 1/2020 | Deal | A41C 3/065 |
| 2006/0276104 | A1 | 12/2006 | Davis | |
| 2010/0029176 | A1 * | 2/2010 | Chen | A41C 3/065 450/38 |
| 2020/0205486 | A1 | 7/2020 | O'leary et al. | |

OTHER PUBLICATIONS

International Search Report & Written Opinion dated Aug. 16, 2022 from PCT Application No. PCT/AU2022/050606.

* cited by examiner

STRAPLESS ADHESIVE BREAST COVERS

FIELD OF THE INVENTION

This invention relates generally to a type of strapless adhesive breast cover.

BACKGROUND OF THE INVENTION

Various types of breasts supports and covers have been proposed, including U.S. Pat. No. 7,152,606 B1 (SCHINDLER) 26 Dec. 2006 which discloses a nipple cover gradually tapering to edges thereof so that the periphery of the cover blends smoothly with a curved portion of the breast while concealing a nipple shape.

JP 3152752 U (ITUKO AOYAMA) 13 Aug. 2009 discloses a brassiere that is less likely to cause eczema, sweat, etc. even when directly adhered to a bust.

WO 2013004168 A1 (WEN JINJI & RHEE JE HO) 10 Jan. 2013 seeks to provide a breathable bonded body pad, which comprises a main part of the body pad and a breathable adhesive layer.

EP 1736066 A1 (PERFECT FORM INTERNATIONAL PTY LTD) 27 Dec. 2006 discloses a backless strapless bra has a pair of silicone gel cups, each with a convex outer surface and a concave inner face with a nipple cavity (16) and an annular adhesive layer extending from the cavity to the periphery (10)

US 20060276104 A1 (DAVIS) 7 Dec. 2006 discloses an adhesive bra which includes a shaped cup portion and an upper extension portion extending from an upper end of the cup portion.

U.S. Pat. No. 8,029,332 B2 (NADSADY ET AL.) 4 Oct. 2011 provides a reusable adhesive bra having an adhesive coating adapted to be removably fastened to a respective one of a user's breasts and having the substantially centrally disposed hole surrounding a respective one of the user's nipples.

The present invention seeks to provide a breast cover and method of use thereof, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided herein a method of wearing a pair of breast covers wherein each breast cover forms a cup shape defining a concave inner surface and a convex outer surface.

Each cover defines an ovular cross section having a major axis and a minor axis and each cover is symmetric with respect to the major axis and asymmetric with respect to the minor axis.

Furthermore, each cover has a peripheral adhesive layer on the inner surface thereby defining an adhesive-free central portion at an intersection of the axes.

The method comprises adhering the covers to respective breasts in first orientations generally symmetric with a centre line therebetween for a first type of garment and in second orientations generally symmetric with the centre line therebetween for a second type of garment.

The symmetry along the major axis allows each cover to be worn interchangeably on either breast, and the asymmetry along the minor axis allows the covers to be worn at different orientations depending on the type of garment.

For example, the covers may be worn orientated upwardly for a low V-neck-style dress, inwardly for a halter-neck-style top, outwardly for a racer-style top or further inwardly for a strapless top.

Furthermore, the collocation of the adhesive-free portion at the intersection of the axes allows the covers to be worn in any orientation without painful adhesion of the nipple.

In embodiments, the cover comprises a minimum diameter of 10 cm. As such, the present covers are larger than conventional nipple covers and contour separately around each breast. The covers can be orientated or worn higher or lower depending on the garment and the amount of cover required. The size and shape of the present covers allow for the wearing thereof on the front of the breast and therefore can accommodate breasts of different shapes and sizes.

Furthermore, the present covers preferably minimise adhesive to reduce discomfort. More specifically, the peripheral adhesive layer may occupy less than approximately half the width of the inner surface along the minor axis and less than approximately half the width of the inner surface along the major axis.

The peripheral adhesive layer may have a substantially uniform radial width so that the adhesive-free layer has the same shape of that of a boundary of the inner surface. As such, the present arrangement maximises the size of the adhesive-free layer whilst securely adhering the periphery of the cover to each breast, ensuring adequate purchase. The maximisation of the adhesive-free portion allows movement tolerance without adhering the nipple, especially along the major axis, thereby allowing each cover to be worn higher or lower depending on the garment.

The covers may comprise a stretchable material so that each cover can be stretched along either axis to conform to the size and shape of the breast.

In embodiments, the cover comprises a sponge layer between stretchable fabric cover layers. These layers may taper towards the peripheral edges thereof to blend seamlessly into clothing whilst allowing a minimum thickness at a central region thereof to conceal the contour of the nipple. In embodiments, the adhesive layer comprises perforations therethrough allowing for breathability through the sponge and fabric layers.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
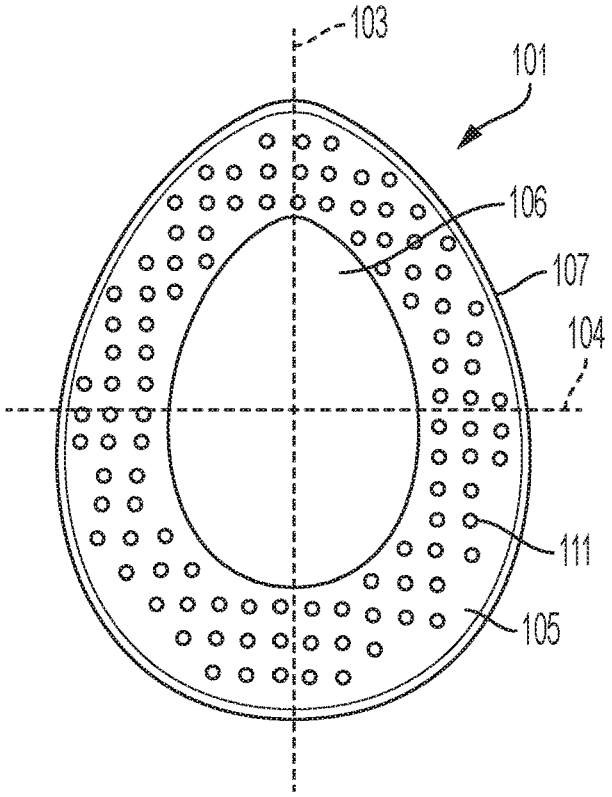
FIG. 1 shows an inner surface of a breast cover in accordance with an embodiment.
Figure 2:
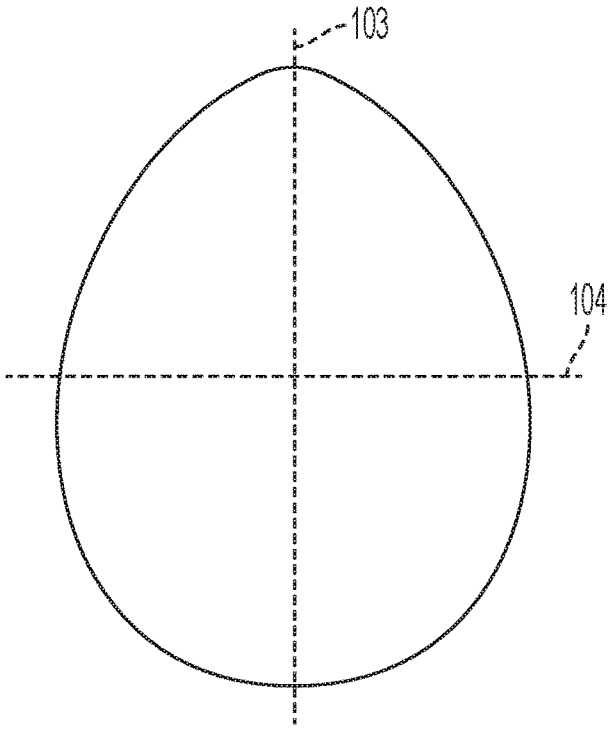
FIG. 2 shows an outer surface of a breast cover in accordance with an embodiment.
Figure 7:
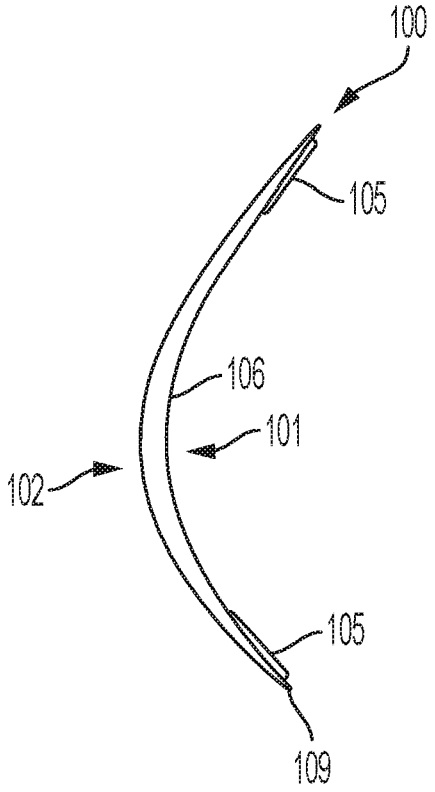
FIG. 7 shows a side cross-sectional view of the cover.

FIG. 7 shows a breast cover 100 forming a cup shape and defining a concave inner surface 101 as shown in FIG. 1 and a convex outer surface 102 is shown in FIG. 2.

With reference to FIG. 2, the cover 100 defines an ovular cross-section having a major axis 103 and a minor axis 104. The cover 100 is symmetric with respect to the major axis and asymmetric with respect to the minor axis 104.

As shown in FIG. 1, the cover 100 has a peripheral adhesive layer 105 on the inner surface 101. The peripheral adhesive layer 105 defines an adhesive-free central portion 106 at an intersection of the axes 103, 104.

The peripheral adhesive layer 105 preferably occupies less than approximately half the width of the inner surface 101 along the minor axis 104. Furthermore, the peripheral adhesive layer 105 also preferably occupies less than approximately half the width of the inner surface 101 along the major axis 103.

In the embodiment shown, the peripheral adhesive layer 105 comprises a substantially uniform radial width. In other words, the peripheral adhesive layer 105 forms a substantially uniform width ovular band around the edge of the inner surface 101. As such, the adhesive-free central portion 106 may have substantially the same shape as a boundary 107 of the inner surface 101 which maximises the length thereof along the major axis 103.

The peripheral adhesive layer 105 preferably comprises a reusable adhesive. Preferably, the reusable adhesive is natural and/or hypoallergenic so as to be suited for the sensitive skin of the breast.

Figure 8:
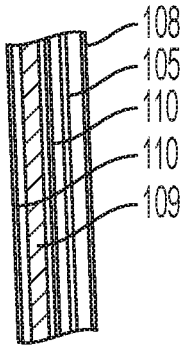
FIG. 8 shows various layers of the cover in accordance an embodiment.

As shown in FIG. 8, the cover 100 may comprise a removable covering 108 for the peripheral adhesive layer 105. The removable covering 108 may have an ovular cross-section matching that of the entire inner surface 101 or alternatively be generally annular, thereby covering the peripheral adhesive layer 105 only.

The peripheral adhesive layer 105 preferably avoids the boundary 107 of the inner surface 101. Preferably, the peripheral adhesive layer 105 avoids the boundary 107 by between 5 and 10 mm, approximately 5 mm in an embodiment.

The cover 100 may comprise a minimum diameter of 10 cm. The cover 100 may be divided in three sizes comprising a small size having a length of approximately 13 cm and a width of approximately 10.5 cm, a medium-size having a length of approximately 14 cm and a width of approximately 11 cm and a large-size having a length of approximately 15 cm and a width of approximately 12 cm.

The cover 100 preferably comprises a material so that the cover 100 is stretchable along either axis 103, 104.

With reference FIG. 8, the cover 100 may comprise a sponge layer 109 between by stretchable fabric cover layers 110.

The adhesive layer 105 preferably comprises perforations 111 therethrough. Preferably, each perforation 111 is greater than 1 mm in diameter and have a maximum 5 mm apart density. Where the cover 100 comprises the sponge layer 109 and the fabric covering 110, the perforations 100 may allow breathability therethrough.

In embodiments, the cover 100 may have a triaxial symmetry wherein, in a particular embodiment, the cover 100 is the shape of a curved triangle, which may be a Reuleaux triangle having a constant width. In accordance with this embodiment, the cover 100 may be worn with any of the corners aligned in various orientations for different types of dresses. In accordance with this embodiment, the peripheral adhesive layer may yet form a band conform in shape with the edges of the cover 100.

Figure 3:
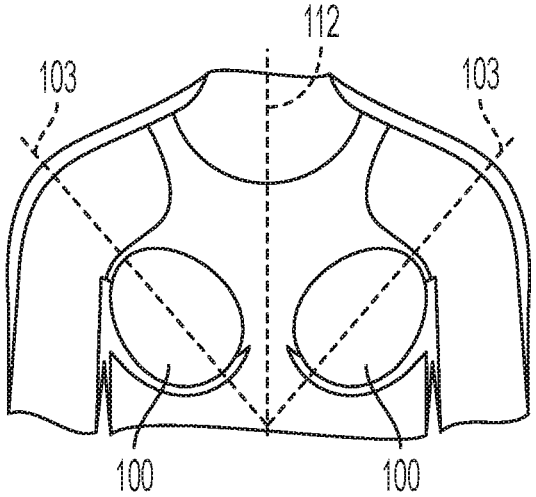
FIGS. 3-6 illustrate methods of wearing a pair of the covers in different orientations according to different types of garments.
Figure 4:
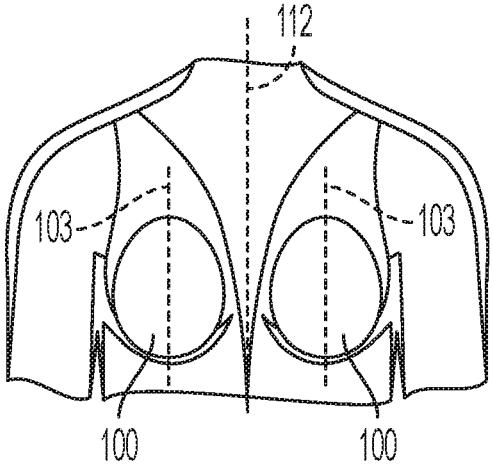
Figure 5:
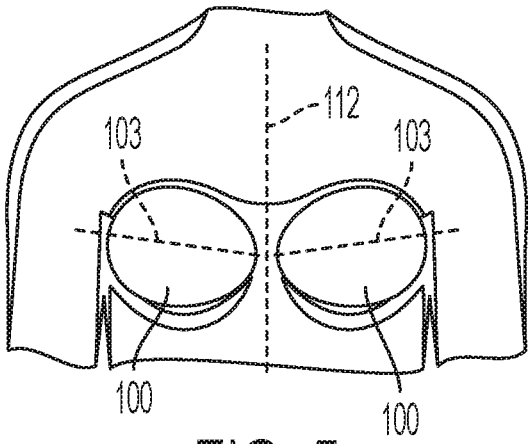
Figure 6:
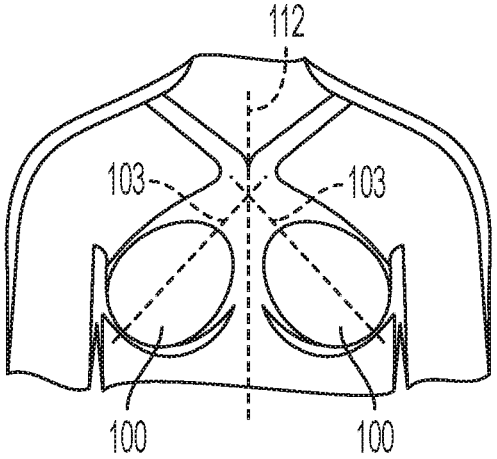

FIGS. 3-6 illustrate wearing the breast covers 100 for different types of garments. More specifically, the method comprises wearing the covers 100 in first orientation which is generally symmetric with a centre line 112 therebetween is shown in FIG. 1 for a first type of garment and wearing the covers 100 in a second orientation which is also generally symmetric with the centre line 112, Specifically, FIG. 4 shows the covers 100 orientated upwardly for a low V-neck-style dress 103, FIG. 6 shows the covers 100 orientated inwardly for a halter-neck-style top 104, FIG. 3 shows the covers 100 orientated outwardly for a racer-style top 105 and FIG. 5 shows the covers 100 inverted and orientated inwardly for a strapless top 106.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A breast cover forming a cup shape defining a concave inner surface and a convex outer surface, defining an ovular cross section having a major axis and a minor axis and being symmetric with respect to the major axis and asymmetric with respect to the minor axis and having a peripheral adhesive layer on the inner surface, the peripheral adhesive layer thereby defining an adhesive-free central portion at an intersection of the axes and wherein the peripheral portion occupies less than half a width of the inner surface along the minor axis and less than half the width of the inner surface along the major axis, wherein a radial width of the peripheral adhesive layer is substantially uniform so that the adhesive-free central portion has a shape that is the same as a boundary of the inner surface.

2. The cover as claimed in claim 1, wherein the peripheral adhesive layer comprises a reusable adhesive.

3. The cover as claimed in claim 1, further comprising a removable covering for the peripheral adhesive layer.

4. The cover as claimed in claim 3, wherein the removable covering has an ovular cross-section matching that of the inner surface.

5. The cover as claimed in claim 4, wherein the removable covering has an opening for the adhesive-free central portion.

6. The cover as claimed in claim 1, wherein the adhesive-free central portion has a length along the major axis.

7. The cover as claimed in claim 1, wherein the peripheral adhesive layer avoids a boundary of the inner surface.

8. The cover as claimed in claim 7, wherein the peripheral adhesive layer avoids a boundary of the inner surface by between 2 and 10 mm.

9. The cover as claimed in claim 1, wherein the cover has a minimum diameter of 10 cm.

10. The cover as claimed in claim 1, wherein the cover has a length of approximately 13 cm and a width of approximately 10.5 cm.

11. The cover as claimed in claim 1, wherein the cover has a length of approximately 14 cm and a width of approximately 11 cm.

12. The cover as claimed in claim 1, wherein the cover has a length of approximately 15 cm and a width of approximately 12 cm.

13. The cover as claimed in claim 1, wherein each cover comprises material so that that each cover is stretchable along either axis.

14. The cover as claimed in claim 13, wherein each cover comprises a sponge layer having a stretchable fabric covering.

15. The cover as claimed in claim 1, wherein the adhesive layer comprises perforations therethrough.

16. A method of wearing a pair of breast covers, each breast cover forming a cup shape defining a concave inner surface and a convex outer surface, defining an ovular cross section having a major axis and a minor axis; and being symmetric with respect to the major axis; and asymmetric with respect to the minor axis and having a peripheral adhesive layer on the inner surface thereby defining an adhesive-free central portion at an intersection of the axes, the method comprising:

adhering the covers to respective breasts:

in first orientations generally symmetric with a center line therebetween for a first type of garment; and in second orientations generally symmetric with the center line therebetween for a second type of garment, wherein a radial width of the peripheral adhesive layer is substantially uniform so that the adhesive-free central portion has a shape that is the same as a boundary of the inner surface.

17. The method as claimed in claim 16, wherein one of the orientations is wherein the major axis is orientated upwardly for a low V-neck-style dress.

18. The method as claimed in claim 16, wherein one of the orientations is wherein the major axis is orientated upwardly inwardly for a halter-neck-style top.

19. The method as claimed in claim 16, wherein the peripheral adhesive layer avoids a boundary of the inner surface.

20. A pair of breast covers, each breast cover forming a cup shape defining a concave inner surface and a convex outer surface, defining an ovular cross section having a major axis and a minor axis and being symmetric with respect to the major axis and asymmetric with respect to the minor axis and having a peripheral adhesive layer on the inner surface, the peripheral adhesive layer thereby defining an adhesive-free central portion at an intersection of the axes and wherein the peripheral portion occupies less than half a width of the inner surface along the minor axis and less than half the width of the inner surface along the major axis and a radial width of the peripheral adhesive layer is substantially uniform so that the adhesive-free central portion has a shape that is the same as a boundary of the inner surface, so that, in use, the breast covers may be adhered to respective breasts:

in first orientations generally symmetric with a center line therebetween for a first type of garment; and in second orientations generally symmetric with the center line therebetween for a second type of garment.

* * * * *